US006502288B2

(12) United States Patent
Black et al.

(10) Patent No.: US 6,502,288 B2
(45) Date of Patent: Jan. 7, 2003

(54) IMAGED NONWOVEN FABRICS

(75) Inventors: Samuel K. Black, Garner, NC (US); Charles Keith Curtis, Benson, NC (US); Cheryl L. Carlson, Willow Springs, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/780,251

(22) Filed: Feb. 9, 2001

(65) Prior Publication Data

US 2002/0007540 A1 Jan. 24, 2002

Related U.S. Application Data

(60) Provisional application No. 60/181,857, filed on Feb. 11, 2000.

(51) Int. Cl.[7] ..... D04H 1/46; D04H 5/02

(52) U.S. Cl. ..... 28/104; 28/163; 28/167

(58) Field of Search ..... 28/104, 105, 106, 28/167, 163, 103; 162/115; 156/148, 62.2, 324; 68/200, 201, 205 R; 8/148, 151; 264/500, 518, 555, 557, 570

(56) References Cited

U.S. PATENT DOCUMENTS

| | | | | | |
|---|---|---|---|---|---|
| 3,485,706 | A | | 12/1969 | Evans | |
| 3,837,046 | A | * | 9/1974 | Kalwaites | 28/105 |
| 3,917,785 | A | * | 11/1975 | Kalwaites | 28/104 |
| 3,933,304 | A | | 1/1976 | Judd | |
| 3,988,343 | A | | 10/1976 | Lilyquist | |
| 4,297,404 | A | * | 10/1981 | Nguyen | 28/105 |
| 4,691,417 | A | * | 9/1987 | Vuillaume | 28/105 |
| 5,098,764 | A | | 3/1992 | Drelich et al. | |
| 5,142,753 | A | * | 9/1992 | Bolliand et al. | 28/167 |
| 5,167,745 | A | * | 12/1992 | Governale | 28/104 |
| 5,301,400 | A | * | 4/1994 | Boulanger | 28/104 |
| 5,301,401 | A | * | 4/1994 | Suzuki et al. | 28/167 |
| 5,475,903 | A | | 12/1995 | Collins | |
| 5,768,756 | A | * | 6/1998 | Noelle | 28/104 |
| 5,791,028 | A | * | 8/1998 | Zolin | 28/104 |
| 5,874,159 | A | | 2/1999 | Cruise et al. | |
| 5,881,440 | A | * | 3/1999 | Deeming et al. | 28/104 |
| 6,306,234 | B1 | * | 10/2001 | Barker et al. | 28/104 |
| 6,324,738 | B1 | * | 12/2001 | Fleissner | 28/104 |

* cited by examiner

*Primary Examiner*—Amy B. Vanatta
(74) *Attorney, Agent, or Firm*—Wood, Phillips, Katz, Clark & Mortimer

(57) ABSTRACT

A method of forming durable nonwoven fabrics by hydroentanglement includes providing a precursor web comprising a fibrous matrix of staple length fibers and/or substantially continuous filaments. The precursor web is subjected to hydroentanglement on a three-dimensional image transfer device to create a patterned and imaged fabric. Enhanced imaging is achieved by advancing the precursor web onto the movable imaging surface of the image transfer device at a rate substantially equal to the rate at which the image surface moves relative to one or more associated hydroentangling manifolds. Treatment with a polymeric binder composition enhances the integrity of the fabric, permitting it to exhibit desired physical characteristics, including strength, durability, softness, and drapeability. Mechanical compaction of the imaged and patterned fabric, such as by sanforizing, enhances the desired physical properties.

12 Claims, 14 Drawing Sheets

IMAGED NONWOVEN FABRICS

CROSS-REFERENCE TO RELATED APPLICATION

This application claims the benefit of Provisional Application Serial No. 60/181,857, filed Feb. 11, 2000.

TECHNICAL FIELD

The present invention relates generally to methods of making nonwoven fabrics, and more particularly to a method of manufacturing at a high rate of speed a nonwoven fabric exhibiting improved physical characteristics while retaining image, permitting use of the fabric in a wide variety of consumer applications.

BACKGROUND OF THE INVENTION

The production of conventional textile fabrics is known to be a complex, multi-step process. The production of fabrics from staple fibers begins with the carding process where the fibers are opened and aligned into a feed stock known as sliver. Several strands of sliver are then drawn multiple times on a drawing frames to further align the fibers, blend, improve uniformity as well as reduce the sliver's diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared, particularly in terms of surface abrasion, pilling and durability in multiple-use applications. Hydroentangled fabrics have been developed with improved properties which are a result of the entanglement of the fibers or filaments in the fabric providing improved fabric integrity. Subsequent to entanglement, fabric durability can be further enhanced by the application of binder compositions and/or by thermal stabilization of the entangled fibrous matrix.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as an aesthetically pleasing appearance.

For specific applications, a nonwoven fabric must exhibit a combination of specific physical characteristics. For example, fabrics used in the home should be soft and drapeable, yet withstand home laundering, and be resistant to abrasion (which can result in fabric pilling). Fabrics used in the home must also exhibit sufficient strength and tear resistance, and colorfastness. These are among the characteristics which have been identified as being desirable for so-called "top-of-the-bed" applications, such as comforters, pillows, dust ruffles, and the like.

Heretofore, attempts have been made to develop nonwoven fabrics exhibiting the necessary aesthetic and physical properties. U.S. Pat. No. 3,933,304, discloses a washable spunlaced nonwoven cloth, with this patent contemplating use of a PAE binder composition (polyamide-amine-epichorohydrin) with inclusion of cotton fiber in the fibrous matrix.

U.S. Pat. No. 3,988,343, discloses a nylon fabric treated with a mixture of acrylic polymer and latex binder with tinting pigments. U.S. Pat. No. 5,874,159 contemplates providing a spunlaced fabric structure with durability by the provision of a bonding material in the form of a thermal plastic polymer, which may be provided in the form of a net, an apertured or punctured film, or molten drop form. The bonding material acts to join layers or laminations from which the fabric is formed.

Notwithstanding various attempts in the prior art to develop a nonwoven fabric acceptable for home use applications, a need continues to exist for a nonwoven fabric which provides the desired softness and drapeability, as well as the requisite mechanical characteristics.

SUMMARY OF THE INVENTION

The present invention is directed to a method of forming a nonwoven fabric, which exhibits enhanced physical characteristics which are achieved through enhanced imaging and patterning on a three-dimensional image transfer device. In particular, the present invention contemplates that a fabric is formed from a precursor web which is subjected to hydroentanglement on a moveable imaging surface of the three-dimensional image transfer device. Enhanced imaging is achieved, with resultant improvement in physical properties, by advancing the precursor web onto the imaging surface at a rate substantially equal to the rate at which the imaging surface moves. By formation in this fashion, hydroentanglement of the precursor web results in improved entanglement of the fibrous matrix from which the web is formed, comprising either staple length fibers and/or filaments. Enhancement of Z-direction entanglement has been observed, with resultant fabrics exhibiting characteristics which, in many important respects, are like those of traditional woven fabrics.

In accordance with the present invention, a method of making a nonwoven fabric embodying the present invention includes the steps of providing a precursor web comprising a fibrous matrix. While use of staple length fibers is typical, the fibrous matrix may comprise substantially continuous filaments. In a particularly preferred form, the fibrous matrix is carded and cross-lapped to form a precursor web. It is also preferred that the precursor web be subjected to pre-entangling on a foraminous forming surface prior to imaging and patterning.

The present method further contemplates the provision of a three-dimensional image transfer device having a movable imaging surface. In a typical configuration, the image transfer device may comprise a drum-like apparatus which is rotatable with respect to one or more hydroentangling manifolds.

The precursor web is advanced onto the imaging surface of the image transfer device so that the web moves together with the imaging surface. Hydroentanglement of the precursor web is effected to form an imaged and patterned fabric. Significantly, the rate at which the precursor web is advanced onto the moveable imaging surface is substantially equal to the rate of movement of the imaging surface. Advancement of the precursor web in this fashion acts to minimize tension therein, with support of the precursor web being contemplated in order to minimize tension.

As will be appreciated, minimization of tension in the precursor web acts to desirably enhance imaging and patterning of the precursor web on the image transfer device. Enhanced fiber entanglement is achieved, with resultant improvement in physical properties of the fabric being formed. Z-direction entanglement is particularly improved.

Subsequent to hydroentanglement, the imaged and patterned fabric may be subjected to one or more variety of post-entanglement treatments. Such treatments may include application of a polymeric binder composition, mechanical compacting, application of a flame-retardant composition, and like processes.

A further aspect of the present invention is directed to a method of forming a durable nonwoven fabric which exhibits a sufficient degree of softness and drapeability, while providing the necessary resistance to tearing and abrasion, to facilitate use in a wide variety of applications. The fabric exhibits a high degree of launderability, thus permitting its use in those applications in which the fabric may become soiled, and thus require home laundering.

A method of making the present durable nonwoven fabric comprises the steps of providing a precursor web which is subjected to hydroentangling. A polyester/nylon fiber blend has been found to desirably yield soft hand and good fabric drapeability. The precursor web is formed into an imaged and patterned nonwoven fabric by hydroentanglement on a three-dimensional image transfer device. The image transfer device defines three-dimensional elements against which the precursor web is forced during hydroentangling, whereby the fibrous constituents of the web are imaged and patterned by movement into regions between the three-dimensional elements of the transfer device.

In the preferred form, the precursor web is hydroentangled on a foraminous surface prior to hydroentangling on the image transfer device. This pre-entangling of the precursor web acts to integrate the fibrous components of the web, but does not impart imaging and patterning as can be achieved through the use of the three-dimensional image transfer device.

Subsequent to hydroentangling, the imaged and patterned nonwoven fabric is treated with a polymer binder composition to lend further integrity to the fabric structure. The polymeric binder composition is selected to enhance durability characteristics of the fabric, while maintaining the desired softness and drapeability of the patterned and imaged fabric.

In order to enhance softness and drapeability of the present nonwoven fabric after it has been treated with the binder composition, the fabric may be subjected to slight mechanical compaction, such as by sanforizing (Sanforized® is a registered trademark of Cluett, Peabody & Co., Inc). Such treatment has been found to enhance hand and drapeability of the fabric, without undesirably adversely affecting the mechanical characteristics of the fabric.

Other features and advantages of the present invention will become readily apparent from the following detailed description, the accompanying drawings, and the appended claims.

DETAILED DESCRIPTION

Figure 1:
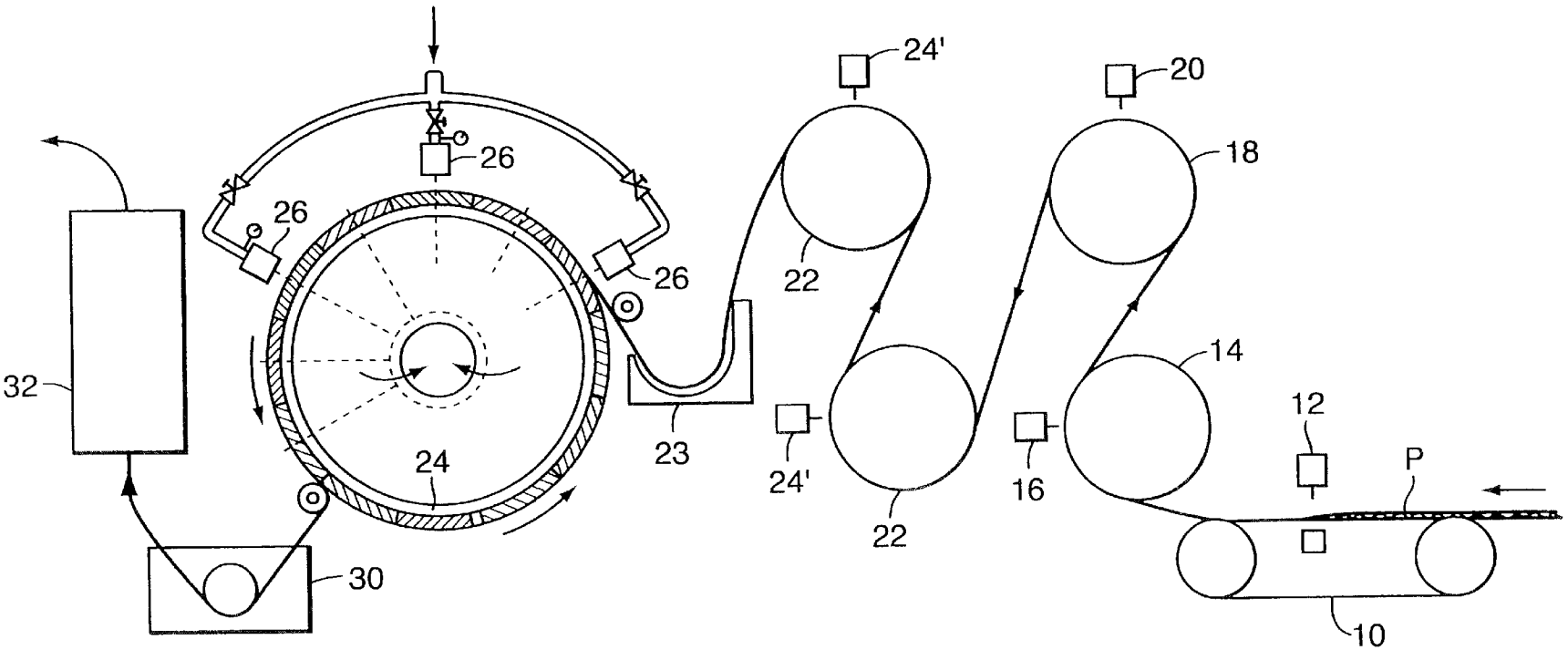
FIG. 1 is a diagrammatic view of an apparatus for manufacturing a durable nonwoven fabric, embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

The present invention is directed to a method of forming nonwoven fabrics by hydroentanglement, wherein imaging and patterning of the fabrics is enhanced by hydroentanglement on the three-dimensional image transfer device. Enhanced imaging is achieved by substantially minimizing and eliminating tension in a precursor web as the web is advanced onto a moveable imaging surface of the image transfer device. By advancing the precursor web onto the imaging surface at a rate substantially equal to the rate of movement of the surface, enhanced fiber entanglement is achieved, with the physical properties, both aesthetic and mechanical, of the resultant fabric being desirably enhanced. Support of the precursor web as it is advanced onto the image transfer device desirably acts to minimize tension therein. Without tension, the fibers or filaments of the fibrous matrix from which the precursor web is formed can more easily move and shift during hydroentanglement, thus resulting in improved imaging and patterning on the image transfer device. A more clearly defined image is achieved.

In accordance with a further aspect of the present invention, a durable nonwoven fabric can be produced which can be employed in bedding applications, with the fabric exhibiting sufficient wash durability (for three home laundering), softness, drapeability, abrasion resistance, strength, and tear resistance, with colorfastness to light, crocking, and laundering. It has been difficult to develop nonwoven fabrics which achieve the desired hand, drape, and pill resistance that is inherent in woven fabrics. Typically, nonwoven fabrics in the 3.0 to 4.0 ounces per square yard range exhibit bulkiness, which in turn detracts from the hand and drapeability of the fabric.

Because nonwoven fabrics are frequently produced using staple length fibers, the fabric typically has a degree of exposed surface fibers that will abrade or "pill" if not sufficiently entangled, and/or not treated with the appropriate polymer chemistries subsequent to hydroentanglement. The present invention provides a finished fabric that can be cut, sewn, and packaged for retail sale. The cost associated with designing/weaving, fabric preparation, dyeing and finishing steps can be desirably reduced.

With reference to FIG. 1, therein is illustrated an apparatus for practicing the present method for forming a nonwoven fabric. The fabric is formed from a fibrous matrix which typically comprises staple length fibers, but may comprise substantially continuous filaments. The fibrous matrix is preferably carded and cross-lapped to form a precursor web, designated P. In a current embodiment, the precursor web comprises 100% cross-lap fibers, that is, all of the fibers of the web have been formed by cross-lapping a carded web so that the fibers are oriented at an angle relative to the machine direction of the resultant web. In this current embodiment, the precursor web has a draft ratio of 2.5 to 1 U.S. Pat. No. 5,475,903, hereby incorporated by reference, illustrates a web drafting apparatus.

FIG. 1 illustrates a hydroentangling apparatus for forming nonwoven fabrics in accordance with the present invention. The apparatus includes a foraminous forming surface in the form of belt 10 upon which the precursor web P is positioned for pre-entangling by entangling manifold 12. Pre-entangling of the precursor web, prior to imaging and patterning, is subsequently effected by movement of the web P sequentially over a drum 14 having a foraminous forming surface, with entangling manifold 16 effecting entanglement of the web. Further entanglement of the web is effected on the foraminous forming surface of a drum 18 by entanglement manifold 20, with the web subsequently passed over successive foraminous drums 20, for successive entangling treatment by entangling manifolds 24', 24'.

The entangling apparatus of FIG. 1 further includes an imaging and patterning drum 24 comprising a three-dimensional image transfer device for effecting imaging and patterning of the now-entangled precursor web. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

The present invention contemplates that the precursor web P be advanced onto the moveable imaging surface of the image transfer device at a rate which is substantially equal to the rate of movement of the imaging surface. As illustrated in FIG. 1, a J-box or scray 23 can be employed for supporting the precursor web P as it is advanced onto the image transfer device to thereby minimize tension within the precursor web. Instead of, or in addition to J-box 23, a driven web roll can be employed for advancing the web P onto the imaging surface of the drum 24 while substantially eliminating tension in the webs. By controlling the rate of advancement of the precursor web onto the imaging surface to minimize, or substantially eliminate, tension within the web, enhanced hydroentanglement of the precursor web is desirably effected. Hydroentanglement results in portions of the precursor web being displaced from on top of the three-dimensional surface elements of the imaging surface to form an imaged and patterned nonwoven fabric. Enhanced Z-direction entanglement is desirably achieved, thus providing improved imaging and patterning, and enhanced physical properties for the resultant fabric.

The accompanying Table 1 sets forth comparative test data for various fabrics formed in accordance with previous hydroentangling techniques, and in accordance with the present invention wherein a precursor web is advanced onto an imaging surface at a rate so as to substantially minimize or eliminate tension therein.

Manufacture of a durable nonwoven fabric embodying the principles of the present invention is initiated by providing the precursor nonwoven web preferably in the form of a blend of polyester and nylon fibers which desirably provides good wrinkle recovery, but heretofore has tended to result in relatively stiff fabrics. During invention development, fiber blend ratios varying from 80 weight percent polyester/20 weight percent nylon to 50 weight percent polyester/50 weight percent nylon were produced and tested. During development, it was ascertained that fabric weights on the order of 3 ounces per square yard provided the best combination of softness, drapeability, hand, and durability.

EXAMPLES

Using a forming apparatus as illustrated in FIG. 1, a nonwoven fabric was made in accordance with the present invention by providing a precursor web comprising 50 weight percent polyester fibers and 50 weight percent nylon fibers. The web had a basis weight of 3 ounces per square yard (plus or minus 7%). The precursor web was 100% carded and cross-lapped, with a draft ratio of 2.5 to 1.

The fabric comprised Wellman Type 072 Microdenier Polyester (0.8 denier) and DuPont Type 200 nylon (1.1 denier). Prior to patterning and imaging of the precursor web, the web was entangled by a series of entangling manifolds such as diagrammatically illustrated in FIG. 1.

FIG. 1 illustrates disposition of precursor web P on a foraminous forming surface in the form of belt 10, with the web acted upon by an entangling manifold 12. The web then passes sequentially over a drum 14 having a foraminous forming surface, for entangling by entangling manifold 16, with the web thereafter directed about the foraminous forming surface of a drum 18 for entangling by entanglement manifold 20. The web is thereafter passed over successive foraminous drums 22, with successive entangling treatment by entangling manifolds 24', 24'. In the present examples, each of the entangling manifolds included 120 micron orifices spaced at 42.3 per inch, with the manifolds successively operated at 50, 100, 125, 125, and 125 bar, with a line speed of 45 yards per minute. A web having a width of 72 inches was employed.

The entangling apparatus of FIG. 1 further includes an imaging and patterning drum 24 comprising a three-dimensional image transfer device for effecting imaging and patterning of the now-entangled precursor web. The entangling apparatus includes a plurality of entangling manifolds 26 which act in cooperation with the three-dimensional image transfer device of drum 24 to effect patterning of the fabric. In the present example, the entangling manifolds 26 were successively operated at 120, 170, and 170 bar, at a line speed which was the same as that used during pre-entanglement.

Figure 2:
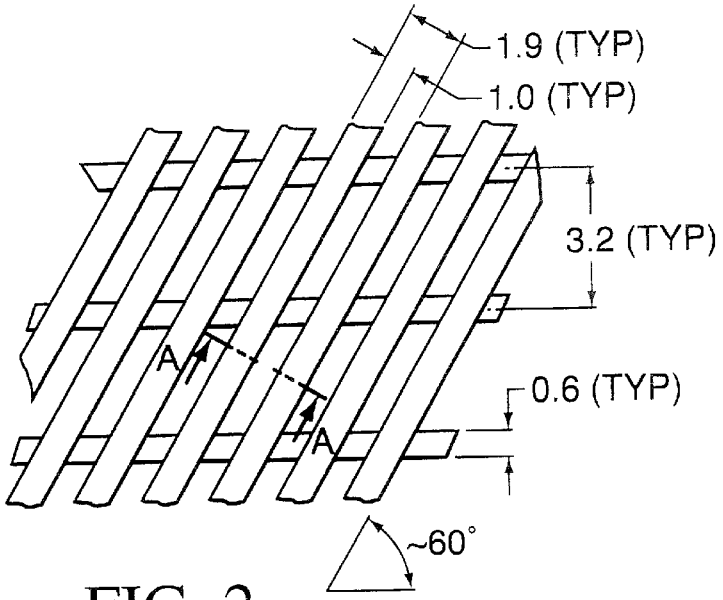
FIG. 2 is a plan view of a three-dimensional image transfer device of the type used for practicing the present invention, with approximate dimension shown in millimeters.
Figure 3:
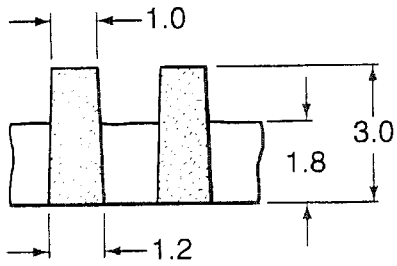
FIG. 3 is a cross-sectional view taken along lines A—A of FIG. 2.
Figure 4:
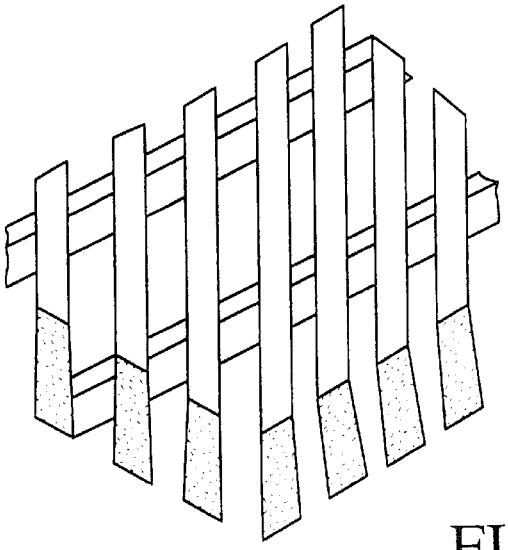
FIG. 4 is an isometric view of the three-dimensional image transfer device shown in FIG. 2.

The three-dimensional image transfer device of drum 24 was configured as a so-called left-hand twill, as illustrated in FIGS. 2, 3, and 4.

Subsequent to patterned hydroentanglement, the fabric receives a substantially uniform application of polymeric binder composition at application station 30. The web is then directed through a tenter apparatus 32, operated at temperatures as specified, with manufacture of the nonwoven fabric of the present invention thus completed.

In the present example, the polymeric binder composition was applied at a line speed of 25 yards per minute, with a nip pressure of 60 psi, mixed solids of 4.57%, and percent wet pick up of approximately 140%. Binder add-on of the imaged fabric was approximately: 3.0 ounces/yd$^2$×140% wet pick-up×4.57 solids =0.137 ounces/yd$^2$.

The composition was applied via dip and nip saturation on a tenter frame No. 4. Tenter oven temperatures were as follows: first zone at 380° F; second zone at 390° F.; third zone at 400° F.

The polymeric binder composition formulation, by weight percent of bath, was as follows:

| | |
|---|---|
| Water | 86.2% |
| Tween ® 20 | 0.2% |
| Griftsoft 1652 | 6.0% |
| Siltouch | 1.0% |
| Unipad Yellow S-3-W | .25% |
| Ultra Scarlet DL-90 | 0.105% |
| Unipad Blue S-3-W | 0.226% |
| Patbind ACB | 2.5% |
| Rhoplex ® K-3 | 2.5% |
| Antimigrant 078 | 0.5% |
| Ammonia Sulfate 35% liquid | 0.6% |

To further enhance the hand and drape of the above-described nonwoven fabric, the fabric was sanforized under the following conditions. The process was operated at a line speed of 38 yards per minute, with the moisturizer switched "off". Compression of 1,000 psi was used, with a roll temperature of 250° F. A sanforizing apparatus as available from Morrison Textile Co., was employed.

The above-described fabrics, having a 50/50 weight percent ratio of polyester fibers to nylon fibers, are designated Sample 1 (non-sanforized) and Sample 2 (sanforized) in the following data.

Further embodiments of the present durable, nonwoven fabric were formed on an apparatus generally in accordance with the arrangement illustrated in FIG. 1. These fabrics were made from blends of staple length polyester and nylon fibers, comprising 80% Wellman micro denier polyester fiber type 472 (0.9 dpf) and 20% DuPont type 200 Nylon (1.1 dpf), at a basis weight of 3 ounces per square yard. The precursor web comprised a 100% carded cross-lapped web, with a draft ratio of 2.5 to 1.

Five pre-entangling manifolds were employed to pre-entangle the precursor web on foraminous forming surfaces, with the manifolds having orifice sizes and spacing as described hereinabove. For these fabrics, the five successive pre-entangling manifolds were operated at 55, 60, 100, 160, and 160 bar. Web speed was 55 yards per minute. Total entangling energy was 0.294 horsepower-hour per pound.

Hydroentangling drum 24 for these samples included a three-dimensional image transfer device configured as described above. The manifolds included orifices sized and spaced as described above. The three successive entangling manifolds were operated at 120, 170, and 170 bar, with a processing speed as used above during pre-entangling.

These further fabrics were treated with the above-described polymeric binder composition to achieve binder add-on as described above, One of the resultant fabrics was sanforized, in accordance with the above-described processing. Test data for these two further fabrics, designated Samples 3 and 4 (non-sanforized and sanforized, respectively), are set forth in the accompanying Table 2. Drape test data was derived in accordance with The following benchmarks have been established in connection with nonwoven fabrics which exhibit the desired combination of durability, softness, abrasion resistance, etc., for certain home use applications.

| | | |
|---|---|---|
| Fabric Strength | (ASTM D5304) Warp × Fill | 70 lbs. × 50 lbs. |
| Fabric Tear | (ASTM D1424) Warp × Fill | 2.2 lbs. × 1.8 lbs. |
| Dimensional Change | (AATCC 135, 3/IV/A Three Home Launderings Warp × Fill | 3.0% × 3.0% |
| Durable Press Rating | (AATCC 124) Three Home Launderings | Rating of 3.0 minimum |
| Brush Pill Rating | (ASTM D3511) | Rating of 3.0 minimum |
| Colorfastness to Light | (AATC 16A) 20 hours | Rating of 3.0 minimum |
| Colorfastness to Laundering | (AATCC 61 3A) | Rating of 2.5 minimum |
| Colorfastness To Crocking | (AATCC 8) | Wet: 3.0 minimum Dry: 4.0 minimum |

The test data shows that nonwoven fabrics approaching, meeting, or exceeding the various above-described benchmarks for fabric performance can be achieved with fabrics formed in accordance with the present invention. Fabrics having basis weights between about 2.5 ounces per square yard and 3.5 ounces per square yard are preferred, with fabrics having basis weights of about 3.0 ounces per square yard being most preferred. It is desirable to minimize bulk of the nonwoven fabric, with fabrics formed in accordance with the present invention having bulks no more than about 25.5 mils. Minimization of fabric bulk enhances hand and drape of the fabric. The desired aesthetic qualities of the present nonwoven fabrics are achieved by having tested drape, in the machine direction, being no more than about 12.0 cm. Fabrics formed in accordance with the present invention are capable of withstanding limited washing, which is suitable for "top-of-bed" applications.

Figure 5A:
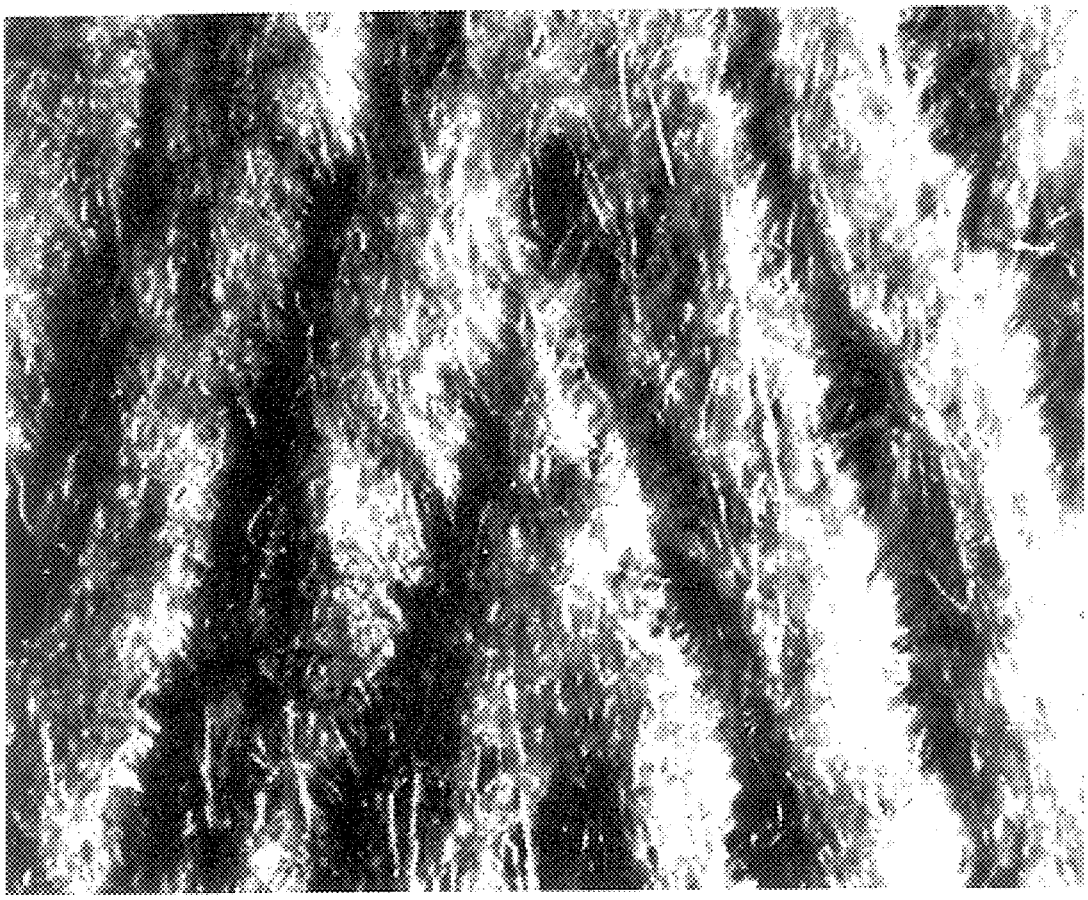
FIGS. 5*a* to 5*c* are photomicrographs of top-lighted samples of a control fabric, and fabrics formed in accordance with the present invention.
Figure 5B:
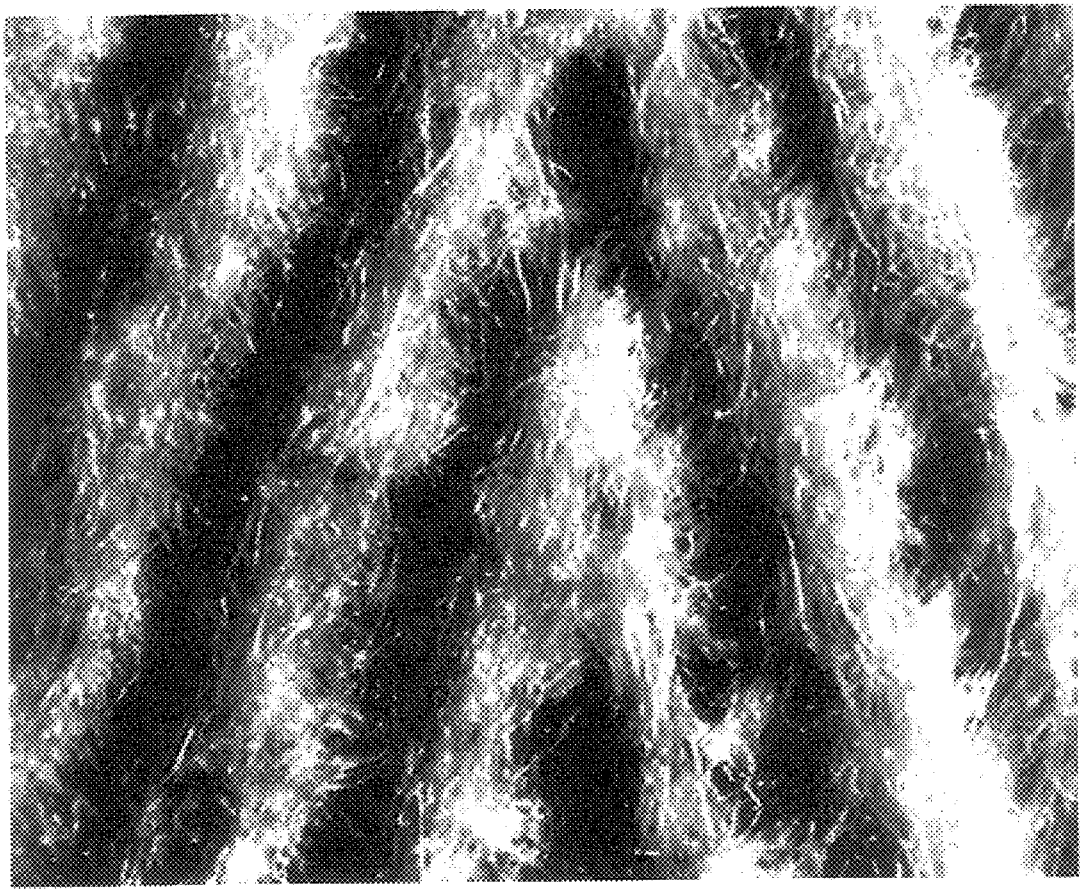
Figure 5C:
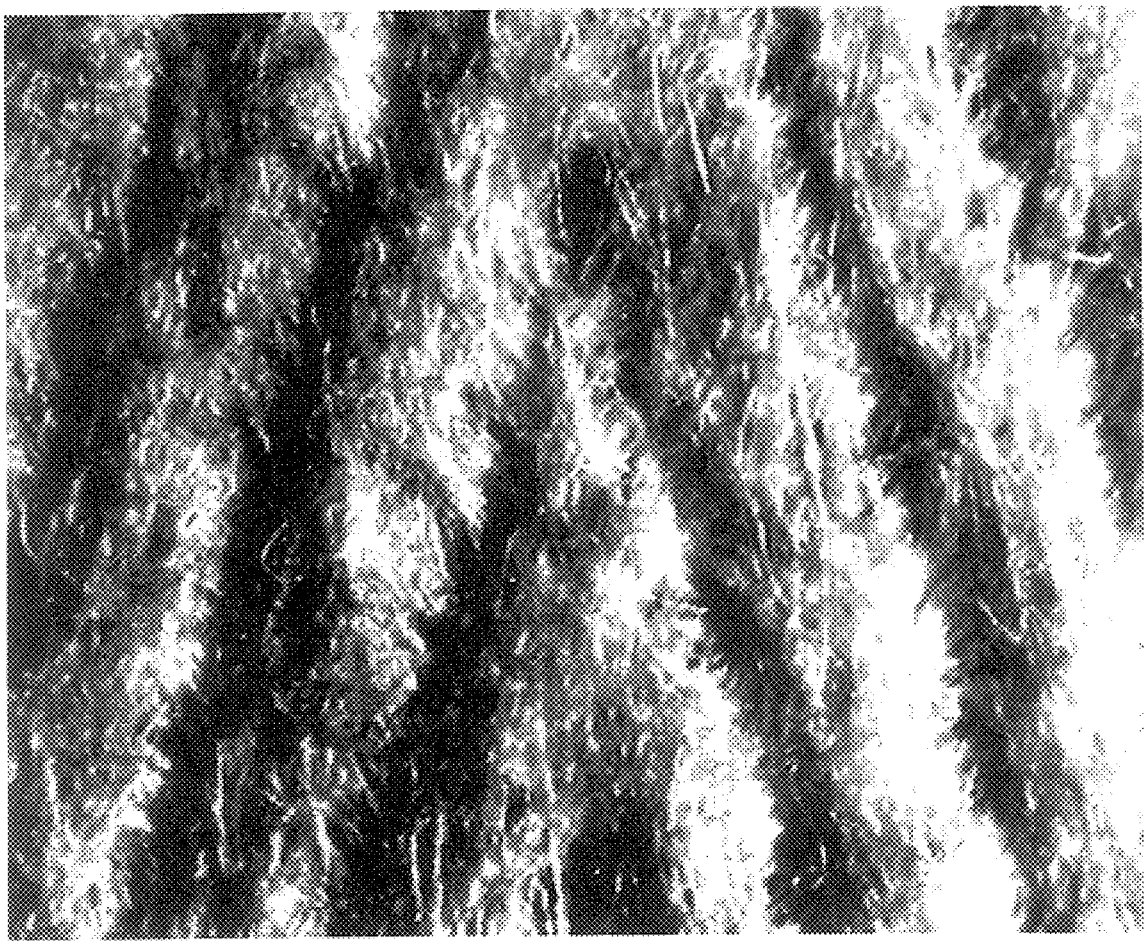
Figure 6A:
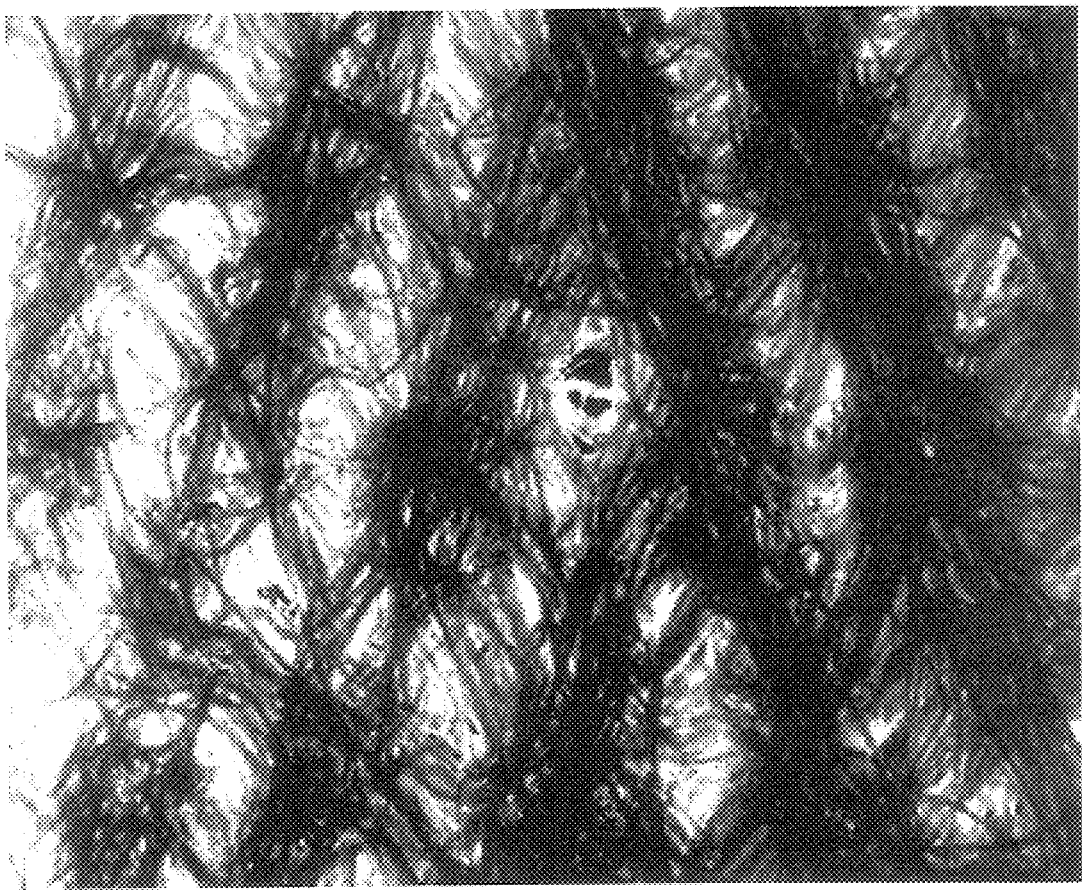
FIGS. 6*a* to 6*c* are back-lighted photomicrographs (using a light box) of the samples shown in FIGS. 5*a* to 5*c*.
Figure 6B:
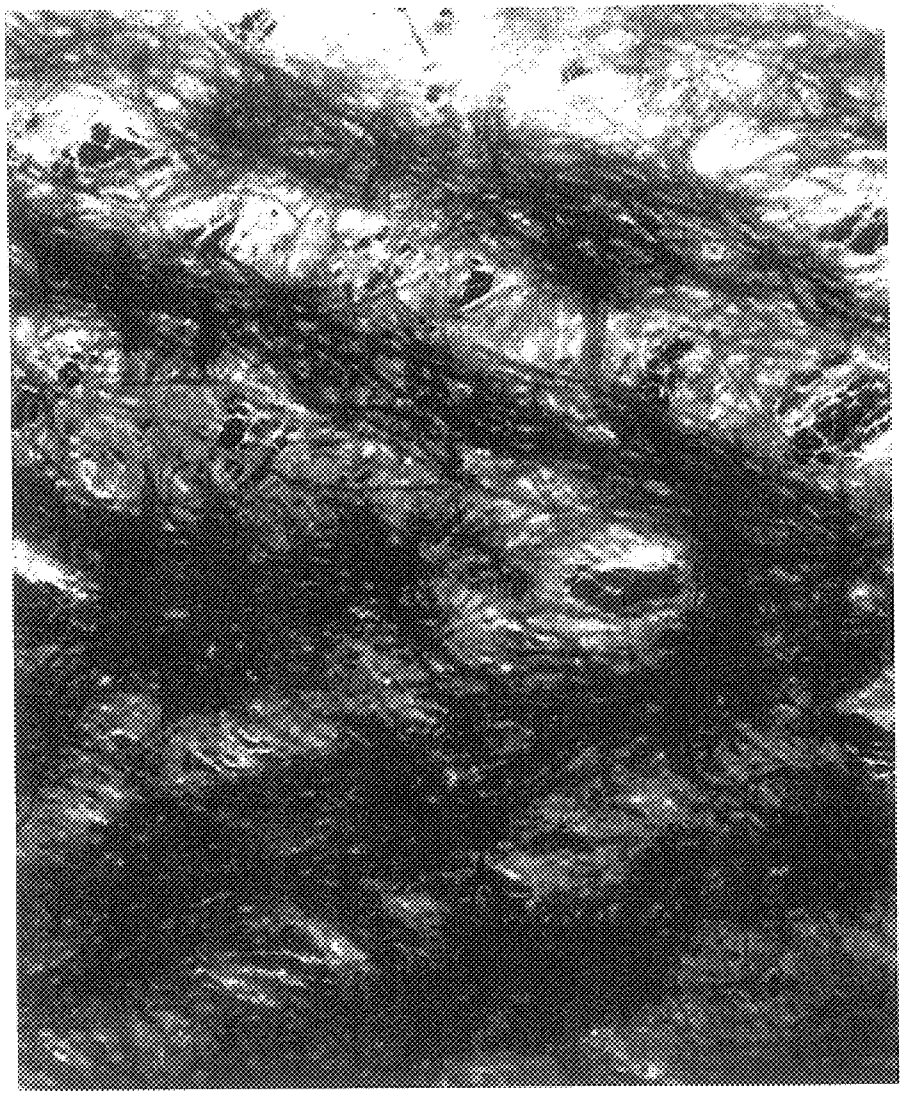
Figure 6C:
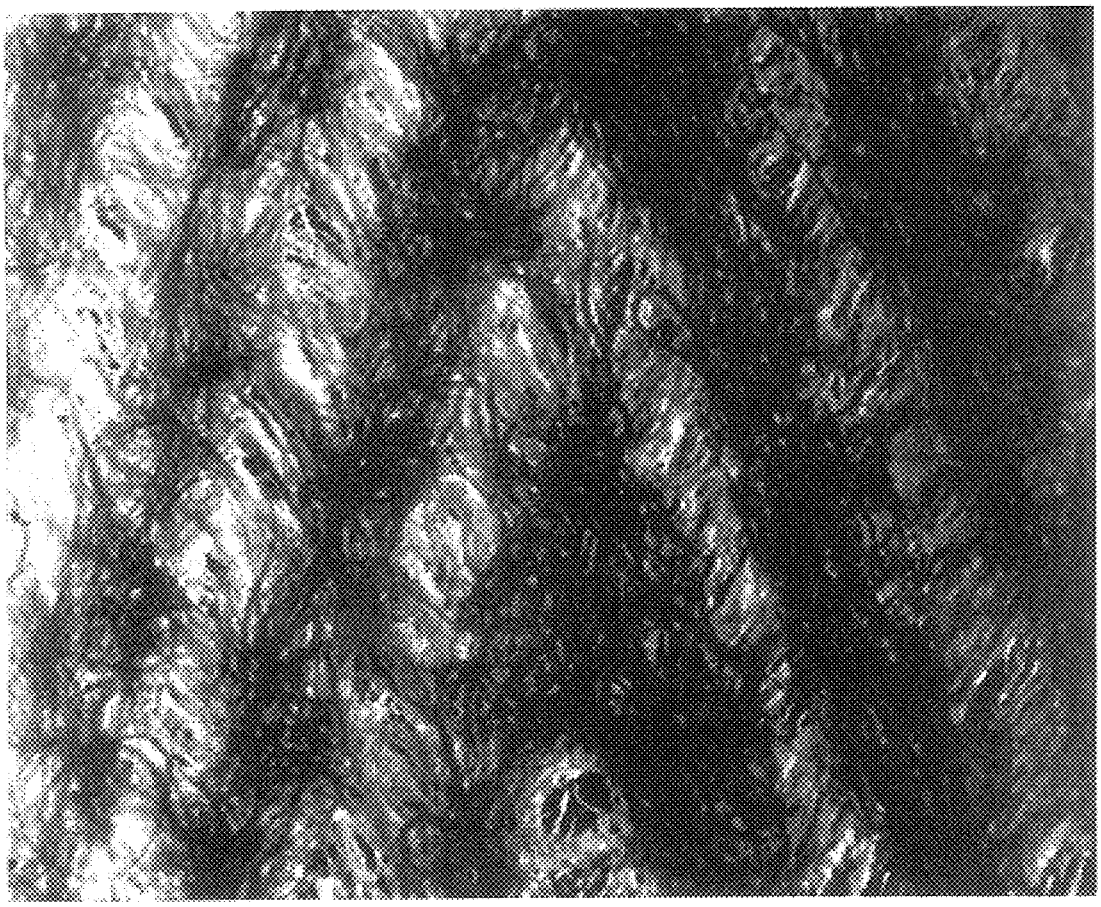
Figure 7A:
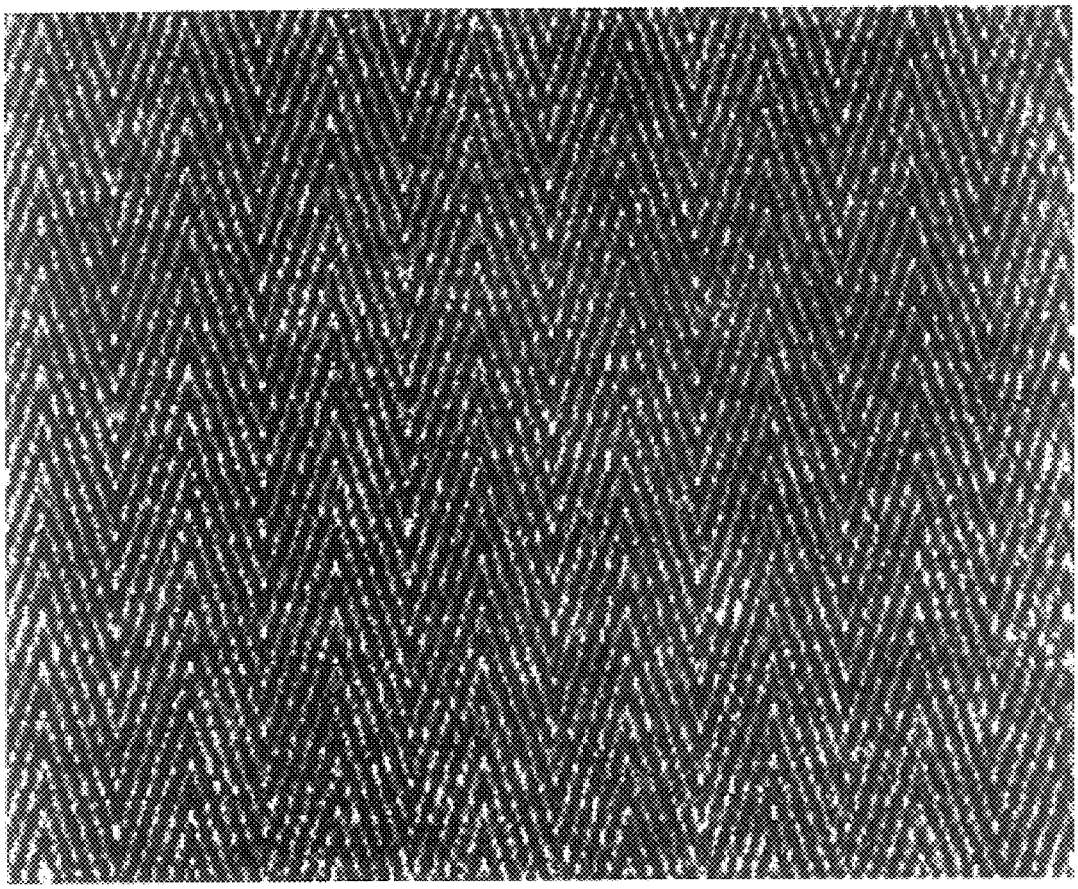
FIGS. 7*a* to 7*c* are back-lighted images of the fabrics shown in FIGS. 5*a* to 5*c* and FIGS. 6*a* to 6*c*.
Figure 7B:
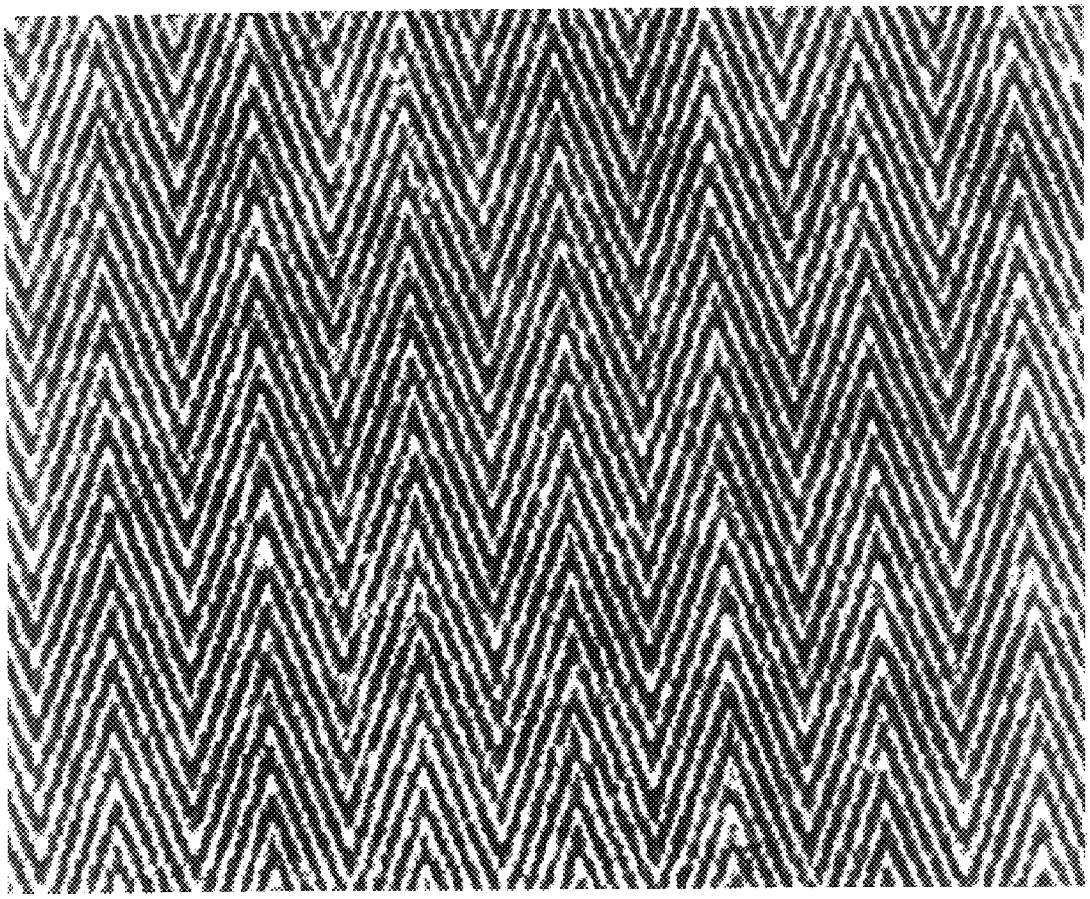
Figure 7C:
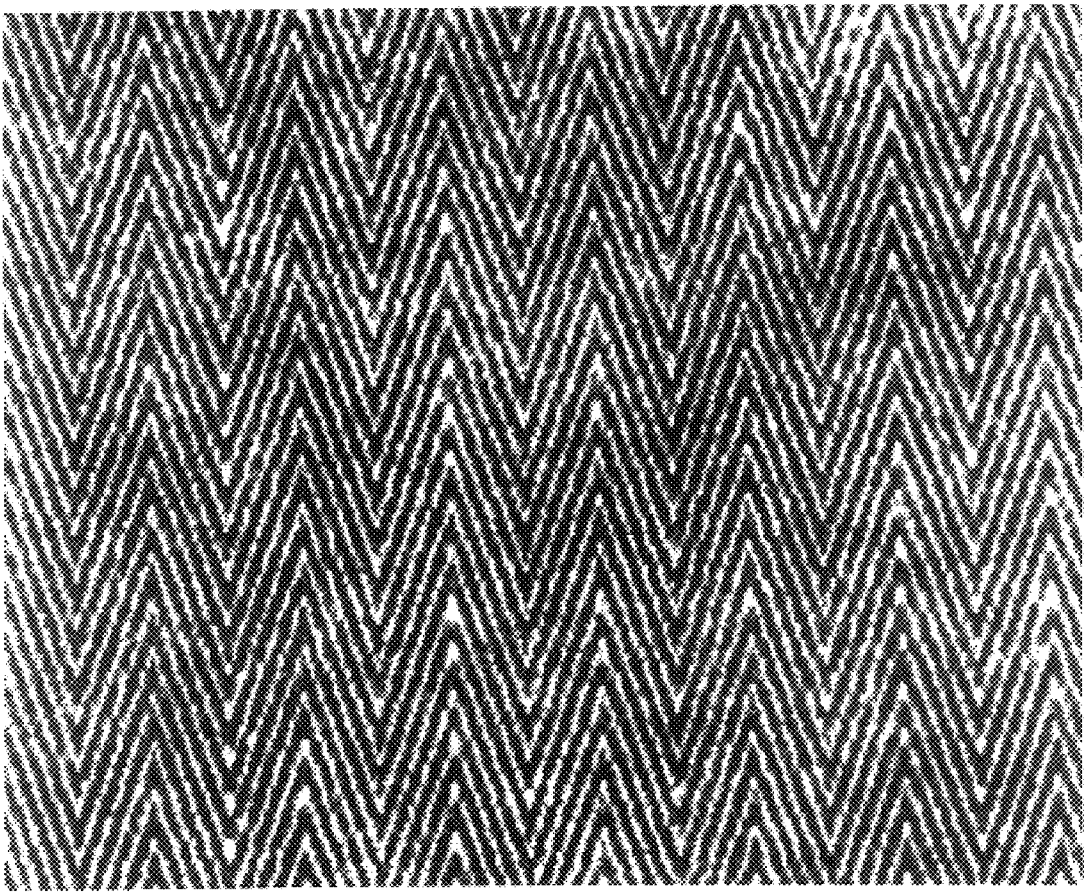
Figure 8A:
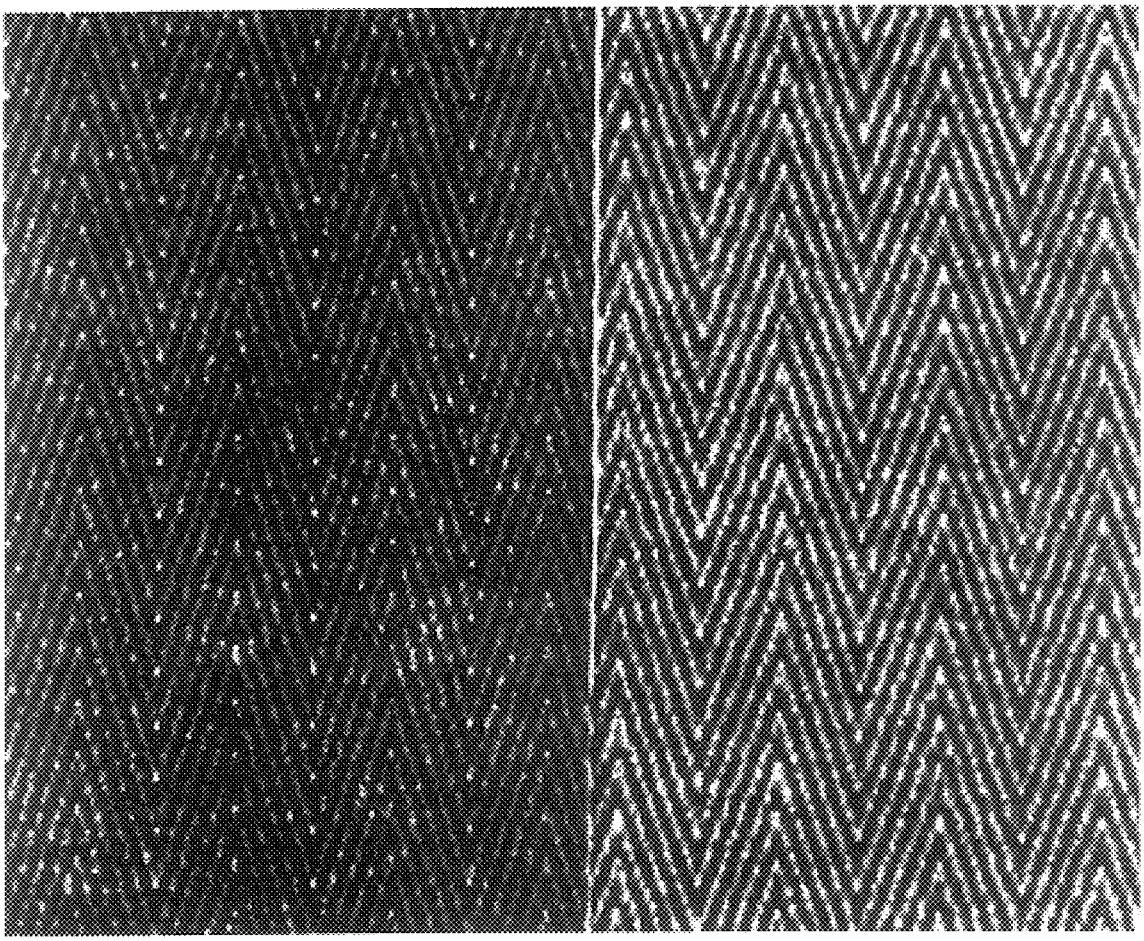
FIGS. 8*a* to 8*c* are comparative images of the fabric samples shown in FIGS. 7*a* to 7*c*.
Figure 8B:
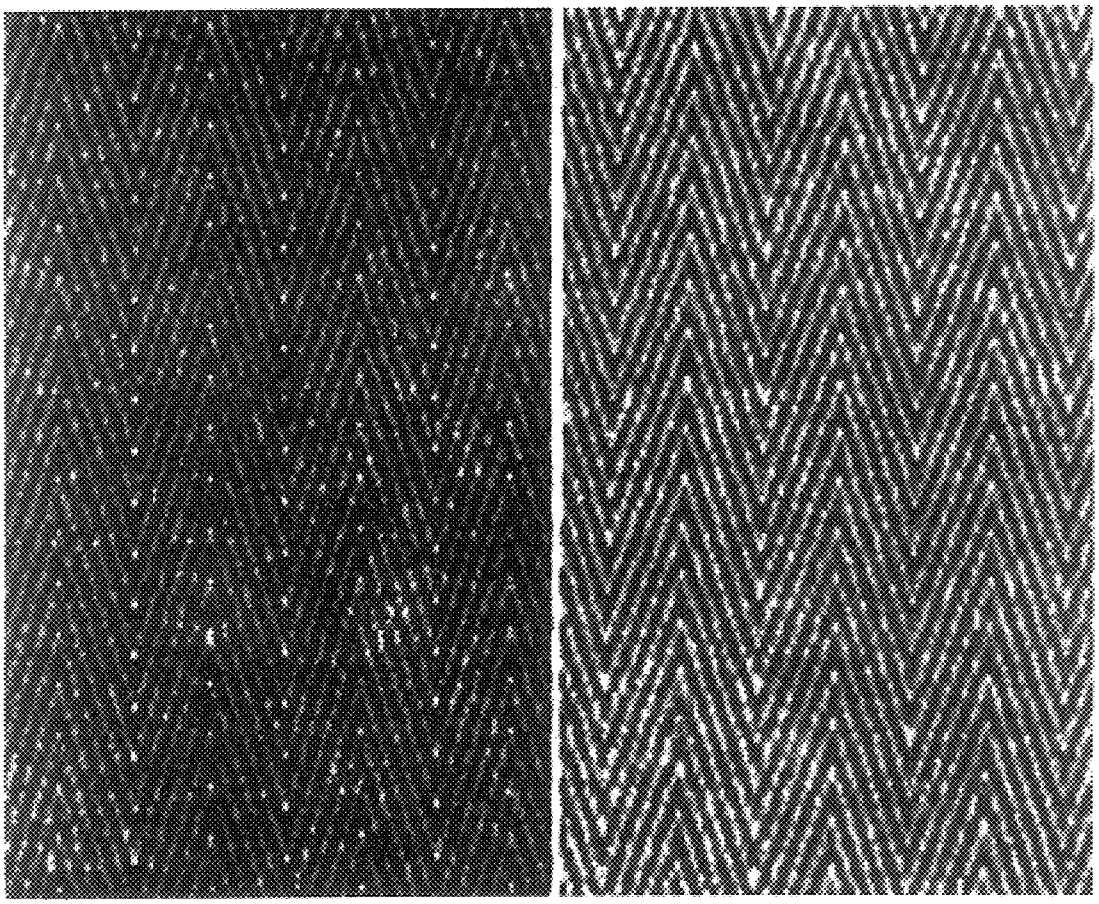
Figure 8C:
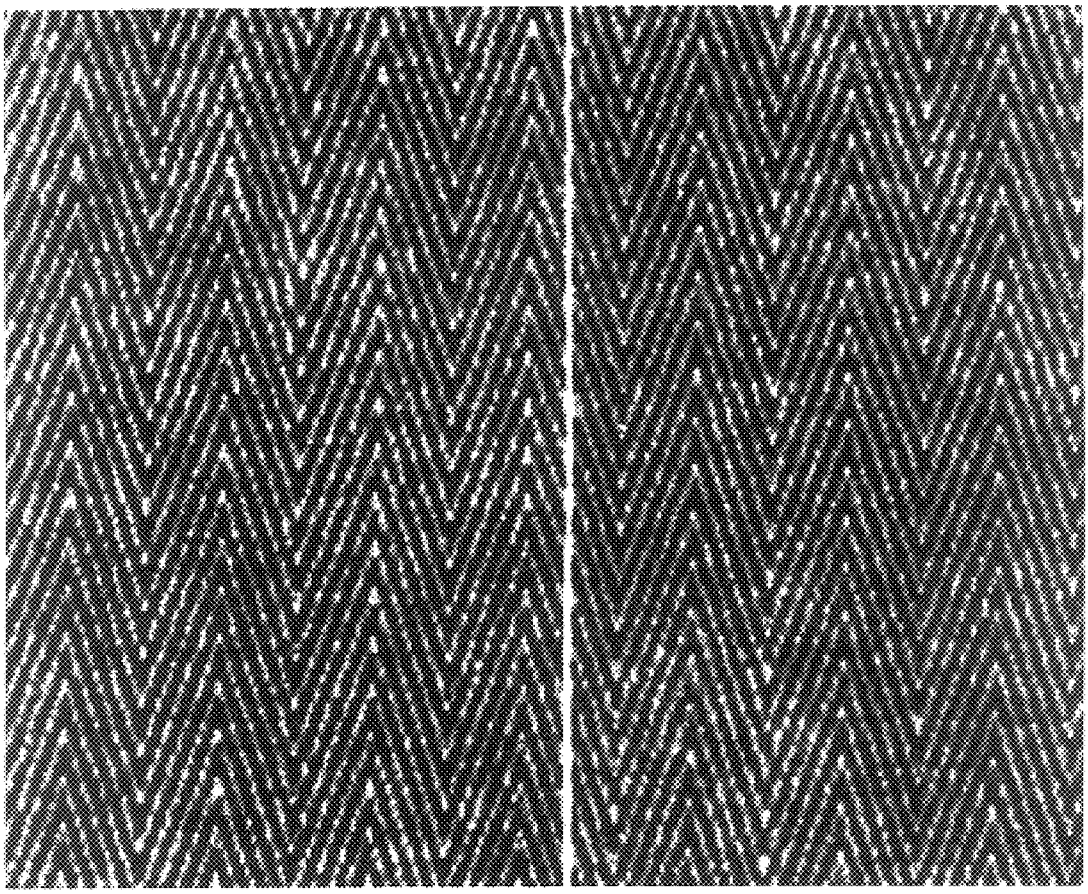

Photographic images of a control fabric, and fabrics formed in accordance with the present invention, are shown in the appended FIGS. 5*a* to 5*b*, 6*a* to 6*b*, 7*a* to 7*b*, and 8*a* to 8*b*. All of these fabrics were formed on an image transfer device configured with a "herringbone" pattern. FIGS. 5*a* to 5*b*, taken at 2.5× magnification, show a control fabric (FIG. 5*a*), and two fabrics formed in accordance with the present invention (FIGS. 5*b* and 5*c*) with each of these images being lighted from the top of the fabric samples. FIGS. 6*a* to 6*c* illustrate the fabric samples at the same magnification, but back-lighted by disposition on a light box. FIGS. 7*a* to 7*c* are full-size images of the fabric samples, with FIGS. 8*a* to 8*c* showing comparative images of the fabric samples.

The control fabric (FIG. 5*a*, FIG. 6*a*, FIG. 7*a*, and the left-hand image in FIGS. 8*a* and 8*b*, was formed under generally standardized processing conditions, including typical tensioning of the fibrous precursor web as it was directed onto the imaging surface of the image transfer device such as shown at 24 in FIG. 1. Sample No. 1 (FIG. 5*b*, FIG. 6*b*, FIG. 7*b*, the right-hand image in FIG. 8*a*, and the left-hand image in FIG. 8*c*) was processed at the same speed as the control sample (40 feet/minute), but the precursor web was directed onto the imaging surface at substantially the same speed at which the surface was moving, thereby introducing the fibrous matrix onto the imaging surface with substantially no tension. Sample No. 2 (FIG. 5*c*, FIG. 6*c*, FIG. 7*c*, the right-hand image of FIG. 8*b*, and the right-hand image of FIG. 8*c*) was processed at approximately 50% greater speed than the control or Sample No. 1, but like Sample No. 1, was processed with substantially no tension in the fibrous matrix as it was directed onto the image transfer device.

All of the samples were fabricated from so-called splittable fibers, that is, fibers which have individual subcomponents which become separated and entangled attendant to hydroentanglement. Notably, the images illustrate the effectiveness of the formation technique of the present invention, wherein fibrous webs to be hydroentangled and imaged on the image transfer device are subjected to substantially no tension as they are introduced onto the imaging surface. As will be observed, Samples No. 1 and 2 show enhanced splitting of the splittable fibers from which they are formed, in comparison to the control sample. This is evident by comparison of the magnified images, wherein the relatively fine, sub-components of the splittable fibers can be discerned, with a more random orientation of the fibers. This is evident by the absence of "runs" of fibers generally along the length of the elongated surface elements of the image transfer device (with such "runs" being more evident in the control sample, as shown in FIGS. 5*a* and 6*a*).

The images also illustrate that fabrics formed in accordance with the present invention, with substantially no tension in the precursor web as it is introduced onto the imaging surface, are formed with more efficient use of the hydraulic energy inputted to the fiber webs as they are hydroentangled and imaged. This is evidenced by the absence of fibers between the three-dimensional surface elements of the imaging surface, with better displacement of the fibers off of these three-dimensional surfaces during imaging. This is particularly evident from comparison of FIG. 5*a*, where depressed regions of the fabric correspond to the three-dimensional surface elements of the forming surface. As will be observed by comparing FIG. 5*b* to FIG. 5*a*, the substantial absence of tension in the sample of FIG. 5*b* shows a greater displacement of the fibers off of the three-dimensional elements of the forming surface, and thus, a lower level of fibers in the depressed regions of the fabric, as compared to the control sample shown in FIG. 5*a*.

Comparison of the control sample shown in FIG. 7*a*, with fabrics of the present invention shown in FIGS. 7*b* and 7*c*, further illustrate the improved definition and imaging achieved through practice of the present invention. In comparison with the fabrics of the present invention, the control sample shown in FIG. 7*a* (positioned on top of a light box) shows a more uniform transmission of light. In contrast, the samples formed in accordance with the present invention, shown in FIGS. 7*b* and 7*c*, show greater definition of the imaging pattern, even at the increased processing speed at which the Sample No. 2 shown in FIG. 7*c* was formed.

FIGS. 8*a* and 8*b* are comparative illustrations of the control fabric (left-side images) and Sample No. 1 and Sample No. 2 (right-hand images), respectively. Again, the greater imaging definition achieved by the present invention is readily apparent. FIG. 8*c* shows a comparison of Sample No. 1 (left-hand image) and Sample No. 2 (right-hand image) showing that the greater image definition achieved through practice of the present invention can be achieved even at increased processing speeds.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

TABLE 1

| Code | Polymer | Drying Method | Weight | Bulk | MD Tensile | MD Elongatio | CD Tensile | CD Elongatio | Mullen Burst | Tear MD | Tear CD | Taber Abrasion | Cant. Bend |
|---|---|---|---|---|---|---|---|---|---|---|---|---|---|
| HH-17 Regular Tension | 70% PET: 30% Nylon | Dry Cans/Tentered | 3.8 | 0.0349[001b].1 | | 50.9 | 87.7 | 83.9 | 170.3 | n/d | n/d | n/d | n/d |
| HH-117-KC Reduced Tension | 70% PET: 30% Nylon | Dry Cans/Tentered | 4.1 | 0.042 | 128.1 | 67.7 | 115.3 | 82.1 | 176.7 | n/d | n/d | >100 | 13.2 |
| Effect of Reduced Tension | | | 7% | 20% | 7% | 25% | 24% | −2% | 4% | n/d | n/d | n/d | n/d |
| Oct/Sq. 11600 Regular Tension | 70% PET: 30% Nylon | Dry Cans Only | 2.2 | 0.052 | 44.6 | 75.2 | 35.0 | 103.6 | 72.0 | 2669 | 2791 | 71.8 | 7.1 |
| Oct/Sq. 11600 Reduced Tension | 70% PET: 30% Nylon | Dry Cans Only | 2.3 | 0.031 | 46.3 | 62.2 | 46.5 | 57.5 | 88.0 | 2070 | 1798 | >100 | 5.4 |
| Effect of Reduced Tension | | | 3% | −41% | 4% | −17% | 25% | −45% | 18% | −22% | −36% | + | −24% |
| KC-050 Non Imaged/Regular Tension | 100% PET | Dry Cans Only | 3.3 | 0.025 | 93.3 | 34.5 | 58.6 | 68.4 | 150.9 | 2026 | 2518 | >100 | 13.0 |
| KC-050 Non Imaged/Reduced Tension | 100% PET | Dry Cans Only | 3.6 | 0.026 | 94.6 | 38.5 | 64.3 | 68.4 | 156.9 | 2357 | 2769 | >100 | 11.4 |
| Effect of Reduced Tension | | | 8% | 5% | 1% | 10% | 9% | 0% | 4% | 14% | 9% | −= | −12% |
| KC-050 Diamond #1 - Regular Tension | 100% PET | Dry Cans Only | 4.7 | 0.043 | 107.2 | 44.0 | 54.9 | 105.6 | 173.8 | 2207 | 2963 | n/d | 8.7 |
| KC-050 Diamond #1 - Reduced Tension | 100% PET | Dry Cans Only | 4.0 | 0.061 | 83.1 | 56.0 | 65.0 | 79.4 | n/d | 3456 | 3917 | n/d | 7.8 |
| Effect of Reduced Tension | | | −16% | 30% | −22% | 22% | 16% | −25% | n/d | 36% | 24% | n/d | −11% |
| KC-050 Diamond #1 - Regular Tension | 100% PET | Dry Cans/Tentered | 3.4 | 0.033 | 68.0 | 36.8 | 61.6 | 55.3 | 144.2 | 2967 | 2818 | n/d | 11.1 |
| KC-050 Diamond #1 - Reduced Tension | 100% PET | Dry Cans/Tentered | 3.8 | 0.036 | 69.2 | 39.9 | 60.3 | 65.1 | 137.3 | 2480 | 2996 | n/d | 10.2 |
| Effect of Reduced Tension | | | 12% | 9% | −21% | 3% | −2% | 15% | n/d | −16% | 6% | n/d | −8% |
| KC-050 Diamond #2 - Regular Tension | 100% PET | Dry Cans Only | 4.2 | 0.034 | 93.6 | 41.4 | 63.5 | 84.8 | 156.8 | 2427 | 2592 | n/d | 8.8 |
| KC-050 Diamond #2 - Reduced Tension | 100% PET | Dry Cans Only | 3.0 | 0.047 | 89.7 | 55.3 | 68.7 | 72.1 | n/d | 3803 | 3389 | n/d | 7.3 |
| Effect of Reduced Tension | | | −6% | 28% | −4% | 25% | 8% | −15% | n/d | 36% | 24% | n/d | −18% |
| KC-050 Diamond #2 - Regular Tension | 100% PET | Dry Cans/Tentered | 3.4 | 0.031 | 81.6 | 38.5 | 65.1 | 54.9 | 143.8 | 2724 | 2551 | n/d | 11.8 |
| KC-050 Diamond #2 - Reduced Tension | 100% PET | Dry Cans/Tentered | 3.6 | 0.032 | 93.0 | 42.5 | 67.2 | 64.0 | 135.5 | 2369 | 2682 | n/d | 10.9 |
| Effect of Reduced Tension | | | 8% | 5% | 12% | 9% | 3% | 14% | n/d | −13% | 11% | n/d | −8% |
| KC-050 Pique #1 - Regular Tension | 100% PET | Dry Cans Only | 3.9 | 0.032 | 97.2 | 45.1 | 60.9 | 77.5 | 160.8 | 2213 | 2357 | n/d | 7.6 |
| KC-050 Pique #1 - Reduced Tension | 100% PET | Dry Cans Only | 4.1 | 0.045 | 91.8 | 53.5 | 66.6 | 80.8 | n/d | 2982 | 2888 | n/d | 7.1 |
| Effect of Reduced Tension | | | 4% | 29% | −6% | 16% | 9% | 4% | n/d | 26% | 18% | n/d | −9% |
| KC-050 Pique #1 - Regular Tension | 100% PET | Dry Cans/Tentered | 3.3 | 0.030 | 79.2 | 39.5 | 57.7 | 53.1 | 151.5 | 2617 | 2681 | n/d | 11.5 |
| KC-050 Pique #1 - Reduced Tension | 100% PET | Dry Cans/Tentered | 3.8 | 0.032 | 77.8 | 42.2 | 62.5 | 63.0 | 136.8 | 2154 | 2625 | n/d | 10.4 |
| Effect of Reduced Tension | | | 13% | 9% | −2% | 6% | 8% | 16% | n/d | −18% | −2% | n/d | −9% |
| KC-050 Pique #2 - Regular Tesnion | 100% PET | Dry Cans Only | 4.14 | 0.031 | 94.8 | 44.0 | 65.7 | 79.0 | 150.8 | 1846 | 2967 | n/d | 8.2 |
| KC-050 Pique #2 - Reduced Tension | 100% PET | Dry Cans Only | 3.96 | 0.042 | 86.4 | 52.7 | 58.8 | 74.3 | n/d | 2888 | 2996 | n/d | 8.8 |
| Effect of Reduced Tension | | | −4% | 26% | −9% | 17% | −10% | −6% | n/d | 36% | 1% | n/d | 7% |
| KC-050 Pique #2 - Regular Tesnion | 100% PET | Dry Cans/Tentered | 3.27 | 0.030 | 81.5 | 39.2 | 55.9 | 52.7 | 139.6 | 2031 | 2427 | n/d | 10.475 |
| KC-050 Pique #2 - Reduced Tension | 100% PET | Dry Cans/Tentered | 3.78 | 0.034 | 91.9 | 43.6 | 65.8 | 66.5 | 140.5 | 2697 | 3167 | n/d | 11.0 |
| Effect of Reduced Tension | | | 14% | 11% | 11% | 10% | 16% | 19% | n/d | 25% | 23% | n/d | 5% |
| KC-050 Pique #3 - Regular Tension | 100% PET | Dry Cans Only | 4.70 | 0.03 | 107.0 | 42.9 | 59.6 | 96.5 | 152.9 | 2457 | 2955 | n/d | 8.2 |
| KC-050 Pique #3 - Reduced Tension | 100% PET | Dry Cans Only | 4.03 | 0.05 | 91.9 | 51.6 | 60.2 | 87.0 | n/d | 2683 | 2669 | n/d | 7.2 |
| Effect of Reduced Tension | | | −14% | 24% | −14% | 17% | 1% | −10% | n/d | 8% | −10% | n/d | −13% |
| KC-050 Pique #3 - Regular Tension | 100% PET | Dry Cans/Tentered | 3.3 | 0.030 | 84.5 | 38.9 | 56.8 | 59.7 | 142.5 | 1714 | 2564 | n/d | 6.675 |
| KC-050 Pique #3 - Reduced Tension | 100% PET | Dry Cans/Tentered | 3.8 | 0.038 | 89.5 | 44.7 | 66.3 | 65.5 | 133.5 | 2580 | 2589 | n/d | 8.2 |
| Effect of Reduced Tension | | | 14% | 17% | 5% | 13% | 14% | 9% | n/d | 33% | 1% | n/d | 18% |

Process Parameters:
Pre-Entangled Pressure (bars) on 5 Manifolds: 70, 100, 160, 140, 160
Apex^ ™ Pressures on 3 Manifolds: 180, 180, 190
Line Speed: 133 fpm
Regular Tension Differential: +1% between Entangle Cylinder #4 and Apex^ ™
Reduced Tension Differential: −6% between Entangle Cylinder #4 and Apex^ ™

TABLE 2

| Component | Screen Print Samples | | Pigment Pad Dye Samples | |
|---|---|---|---|---|
| | Sample 1 50/50 Micro PET/Nylon | Sample 2 50/50 MicroPET/ Nylon | Sample 3 80/20 PET/Nylon | Sample 4 80/20 PET/Nylon |
| ITD | Left-Hand Twill | Left-Hand Twill | Left-Hand Twill | Left-Hand Twill |
| Weight | 2.94 | 3.0 | 3.32 | 3.34 |
| Bulk | 20 | 23 | 21.7 | 25.5 |
| Tensile MD | 82.02 | 86.5 | 100.7 | 89.7 |
| Tensile CD | 62.84 | 65.1 | 62.32 | 66.9 |
| Elong - MD | 49.08 | 54.7 | 35.14 | 41.24 |
| Elong - CD | 71.32 | 79.7 | 80.27 | 73.53 |
| Softness MD/CD | 118.3/51.5 | 110.2/39.0 | 161.4/70.1 | 161.4/75.9 |
| Tear MD/CD | 14.1/11.7 | 14.1/13.8 | 12.2/11.0 | 12.9/9.4 |
| Drape MD/CD (cm) | 9.1/5.9 | 9.2/4.8 | 12.0/6.9 | 10.6/5.5 |
| Pill Resistance | 3 | 2.5 | 3 | 2.5 |
| Wash Shrinkage MD/CD | −4.4/3.6 | −3.2/2.8 | −2.4/2.8 | −1.6/2.2 |
| Durable Press Rating | 3.0 | 3.0 | 3 | 3 |
| Colorfastness to Crock Dry/Wet | 4.5/4.5 | 4.5/4.0 | 4.5/4.5 | 5/4.5 |
| Colorfastness to Laundering | 4 | 4 | 4 | 4 |
| Colorfastness to Light | 3 | 3 | 4.5 | 4.5 |

What is claimed is:

1. A method of making a nonwoven fabric, comprising the steps of:

providing a precursor web comprising a fibrous matrix;

providing a three-dimensional image transfer device having a movable foraminous imaging surface facing outwardly of said three-dimensional image transfer device;

providing at least one manifold having a plurality of orifices for creating high pressure liquid streams, advancing said precursor web onto said image transfer device so that said web moves with said imaging surface and said web is positioned between said manifold and said imaging surface; and hydroentangling said precursor web on said image transfer device to form an imaged and patterned nonwoven fabric by direction of said liquid streams directly against said precursor web and through said foraminous image transfer device, wherein said advancing step includes advancing said precursor web onto said movable imaging surface of said image transfer device at a rate substantially equal to the rate of movement of said movable imaging surface.

2. A method of making a nonwoven fabric in accordance with claim 1, including:

applying a polymeric binder composition to said imaged and patterned nonwoven fabric.

3. A method of making a nonwoven fabric in accordance with claim 1, including:

applying a flame-retardant composition to said imaged and patterned nonwoven fabric.

4. A method of making a nonwoven fabric in accordance with claim 1, including:

mechanically compacting said imaged and patterned nonwoven fabric.

5. A method of making a nonwoven fabric in accordance with claim 1, including:

supporting said precursor web during said advancing step to minimize tension in said precursor web.

6. A method of making a nonwoven fabric in accordance with claim 1, wherein:

said fibrous matrix comprises staple length fibers.

7. A method of making a nonwoven fabric in accordance with claim 1, wherein:

said fibrous matrix comprises substantially continuous filaments.

8. A method of making a nonwoven fabric, comprising the steps of:

providing a fibrous matrix;

carding said fibrous matrix;

cross-lapping said fibrous matrix to form a precursor web;

entangling said precursor web on a foraminous forming surface;

providing a three-dimensional image transfer device comprising an imaging surface having an array of three-dimensional surface elements, said imaging surface being movable relative to at least one associated hydroentangling manifold which directs high pressure liquid streams directly against said precursor web;

advancing said precursor web onto said movable imaging surface between said imaging surface and said hydroentangling manifold so that said image surface is moving at a rate which is substantially equal to a rate of advancement of said precursor web, including supporting said precursor web to minimize tension therein; and hydroentangling said precursor web on said imaging surface so that portions of said precursor web are displaced by said liquid streams from on top of said three-dimensional surface elements to form an imaged and patterned nonwoven fabric.

9. A method of making a nonwoven fabric in accordance with claim 8 wherein:

said fibrous matrix comprises staple length fibers.

10. A method of making a nonwoven fabric in accordance with claim 8 wherein:

said fibrous matrix comprises substantially continuous filaments.

11. A method of making a nonwoven fabric in accordance with claim 8 including:

applying a polymeric binder composition to said imaged and patterned nonwoven fabric.

12. A method of making a nonwoven fabric in accordance with claim 9, including:

applying a flame-retardant composition to said imaged and patterned nonwoven fabric.

* * * * *